United States Patent [19]

Berger

[11] 4,290,599

[45] Sep. 22, 1981

[54] EXERCISER

[75] Inventor: Isaac Berger, c/o Ike Berger Enterprises, 263 W. 38th St., New York, N.Y. 10018

[73] Assignee: Issac Berger, New York, N.Y.

[21] Appl. No.: 89,214

[22] Filed: Oct. 29, 1979

[51] Int. Cl.[3] ..... A63B 21/00

[52] U.S. Cl. ..... 272/130; 272/137

[58] Field of Search ..... 272/130, 137, 141, 142, 272/99, 116; 277/178, 137, 216; 308/4 R

[56] References Cited

U.S. PATENT DOCUMENTS

| | | | |
|---|---|---|---|
| 737,008 | 8/1903 | Nichol | 272/99 |
| 767,008 | 8/1904 | Pelletier | 272/130 |
| 3,071,800 | 1/1963 | Patriquin | 277/178 |
| 3,174,343 | 3/1965 | Kasulis | 272/130 X |
| 3,471,145 | 10/1969 | Berger | 272/130 |
| 3,592,467 | 7/1971 | Pereira | 272/67 |
| 3,759,514 | 9/1973 | Cox | 272/142 X |
| 3,836,141 | 9/1974 | Franklyn | 272/130 |
| 3,944,221 | 3/1976 | Berkestad | 272/130 |

FOREIGN PATENT DOCUMENTS

| | | | |
|---|---|---|---|
| 1394245 | 5/1975 | United Kingdom | 272/130 |

*Primary Examiner*—Richard J. Johnson

*Attorney, Agent, or Firm*—Kirschstein, Kirschstein, Ottinger & Cobrin

[57] ABSTRACT

An exercising device which relies on a pneumatic resistance element, and in which on alternate strokes air is inducted or expelled. Inner and outer telescoping cylindrical tubes are provided with handles on their outer ends for manipulating the device, by exerting force in tension, to rectilinearly expand the length of the device, and in compression, to rectilinearly contract the length of the device. A flexible resilient washer mounted at the inner end of the inner tube slidably and sealingly engages the inner surface of the outer tube. Oppositely acting check valves are provided together with respective throttling means at the outer end of the outer tube adjacent its handle. The throttling means, typically consisting of a selectively rotatable multiply apertured outer sleeve, selectively connects the check valves to the outer atmosphere, with one check valve permitting only ingress of air into the outer tube and the other check valve only permitting air egress. The degree of throttling is varied by having apertures of varying size in the sleeve.

14 Claims, 6 Drawing Figures

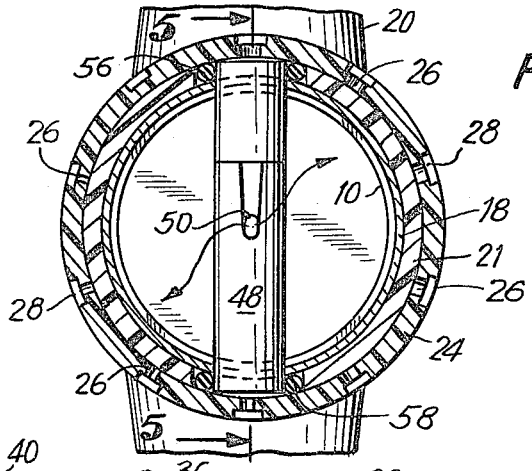
FIG. 4
FIG. 5
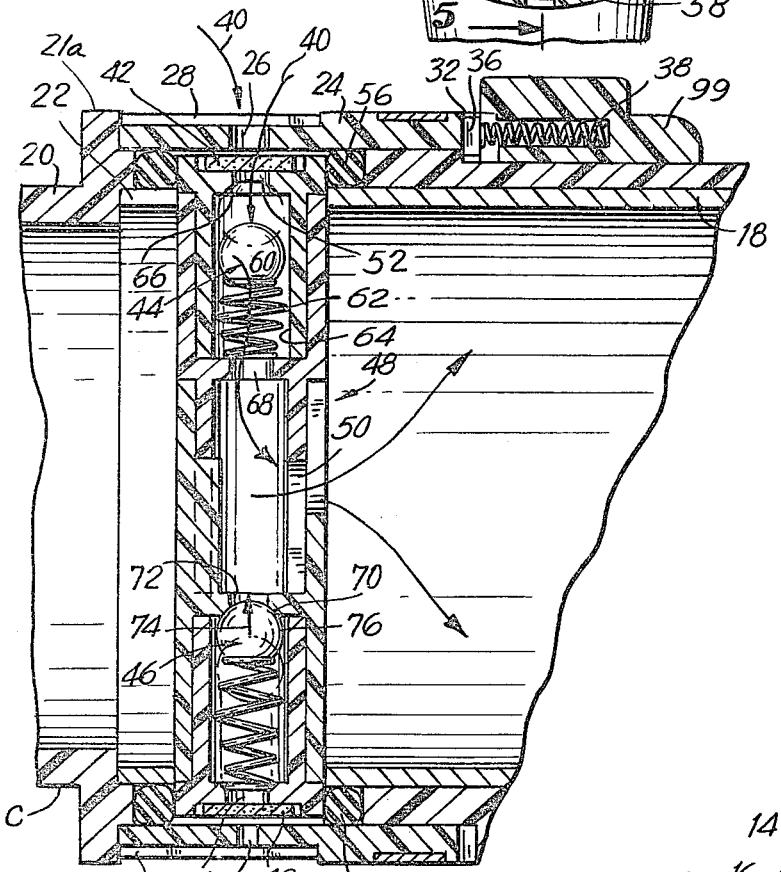
FIG. 6
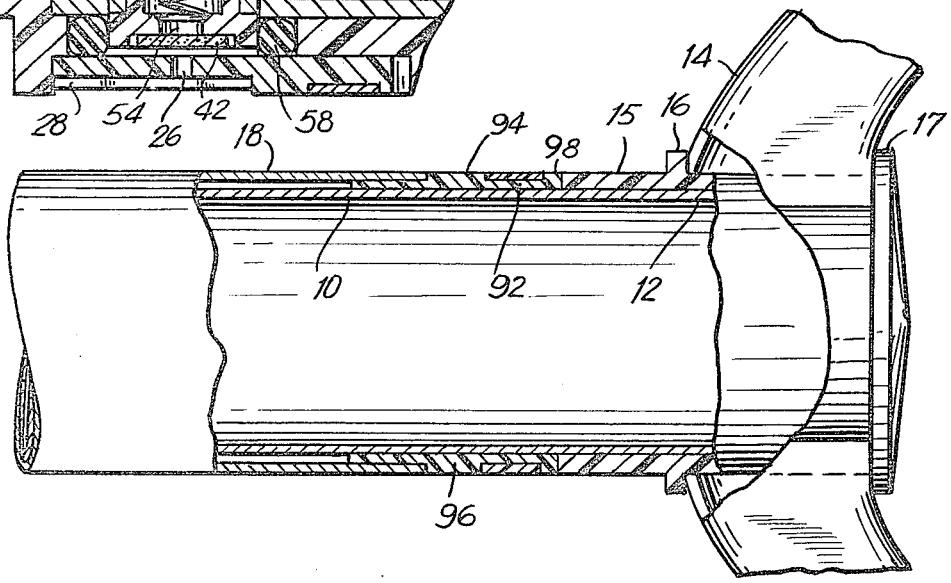

EXERCISER

BACKGROUND OF THE INVENTION

1. Field of the Invention

An exercising device which is expanded and contracted against a pneumatic resistance element.

2. Description of the Prior Art

Conventional linear exercisers employ resilient elements such as springs or elastic bands to offer resistance to manipulation. The person who is exercising typically grasps the device at its ends and pulls apart to stretch the device rectilinearly. However, this type of device has a resistance element which has several disadvantages. Elastic bands tend to deteriorate or break with age due to oxidation. Springs often are twisted out of shape or over-stretched beyond their elastic limit, or catch on fabrics and threads. Elastic bands are only capable of offering resistance in tension and consequently such elements only require exertion in stretch deformation without offering any viable resistance to compression, i.e. when tension force is terminated, compression force is not needed to return the device to it original shorter length and consequently the benefits to the user are diminished. Springs also usually are arranged only to offer resistance in tension. To have springs offer resistance in compression requires the use of compression springs which are too expensive and cumbersome for incorporation in reasonably priced exercisers.

An arm exercising device with a pneumatic resistance element is described in U.S. Pat. No. 3,471,145. Here a single knob selects alternate valves to either restrict air flow into or out of the cavity of the device, with air in the opposite sense in either case being allowed to flow freely; thus, one valve when effective allows air to flow freely out of the cavity or body of the device, e.g. when it is contracted, and controllably restricts flow of air into the cavity, i.e. when the device is expanded or lengthened, and vice versa. Thus, this patent teaches one-way pneumatic resistance, either solely in the tension mode for expansion of the device, or solely in the compression mode for contraction of the device. Said exerciser is difficult to assemble and expensive to constrict.

SUMMARY OF THE INVENTION

1. Purposes of the Invention

It is an object of the present invention to provide an improved exercising device of novel construction which overcomes the above described drawbacks.

A further object is to provide an exercising device with a pneumatic resistance element which, in addition to two modes in one of which it provides only compression and in the other only tension, has a third mode in which it provides tension and compression upon alternate strokes.

Still a further object is to provide an exerciser which constitutes relatively few and simple parts, and which is easy and inexpensive to manufacture with mass production facilities using unskilled labor.

2. Brief Description of the Invention

The present invention provides an improved exercising device with a pneumatic resistance element. The device includes an inner tube, an outer tube in telescoping relationship with the inner tube, and handles on the outer ends of the two tubes for manipulation of the device in tension and compression modes.

The inner end of the inner tube terminates short of the outer end of the outer tube when the tubes are fully telescoped. A flexible resilient washer is mounted on the inner end of the inner tube, to slidably and sealingly engage the inner surface of the outer tube. The outer end of the outer tube is closed.

First and second check valves are disposed within the outer tube, between the outer end of the outer tube and the flexible resilient washer. First and second throttling means are provided, each throttling means being associated with a different one of the check valves and serving to connect its respective check valve to the outer atmosphere. The first check valve permits ingress of air into the space defined by the tubes, but prevents egress of air from said space. The second check valve prevents ingress of air into the space defined by the tubes, but permits egress of air from said space.

The exerciser is manipulated by grasping different ones of the two opposed handles with different ones of the user's hands, and alternately pulling the two tubes away from one another to extend the exerciser, and pushing the two tubes towards one another to contract the exerciser. Thus, air alternately flows into the space defined by the tubes through a throttling means and one associated open check valve, the other check valve being closed, and then out of said space via the other check valve (now open) and associated throttling means, the one check valve now being closed. Depending upon the selection chosen by the user air is forced through one or the other of the throttling means, the selected means being a flow restricting aperture. The other throttling means is a large aperture that exerts only a negligible resistance to the flow of air.

Preferably the inner tube and the outer tube are cylindrical, with the outer tube being concentrically disposed about the inner tube. The flexible resilient washer acts like a piston in a bore to prevent air from flowing freely past it. The peripheral shape of the washer matches the inner cross-sectional shape of the outer tube. In the illustrated preferred embodiment, the washer flares outwardly to a greater thickness adjacent its circular periphery.

It is preferred that a specific configuration of check valve orientation and construction be provided. Thus the first and second check valves are mounted at opposite ends of a two-piece hollow diametrical fitting which is oriented transversely to the central longitudinal axis of the outer tube, and which has a side opening proximately midway of its length for ingress or egress of air, into or out of the outer tube. The fitting has outer openings at each end for respective flow of air to or from the atmosphere. Typically, each check valve includes a spring-loaded ball in a different chamber within the fitting, each chamber having a seat for the associated ball at one end. Each ball seat has a central opening for the passage of air. Each chamber also has an opening at the chamber end opposite to the ball seat for passage of air. One ball seat is at the outer end of its chamber so that its central opening connects to the atmosphere. The other ball seat is at the inner end of its chamber so that its central opening connects to the aforementioned side opening of the fitting. A muffler is mounted over each outer end opening of the fitting to reduce the whistling sound that accompanies the flow of air through the check valves and restricted apertures. The muffler on the intake check valve also limits the entry of dust into the device.

One important aspect of the invention is a configuration whereby the opposition to air flow exerted by the first and second throttling means is easily variable, so that the pneumatic resistance of the device may be changed quickly and easily. In one preferred embodiment of the invention, the first and second throttling means are part of a rotatable multiply apertured sleeve which is disposed about the outer tube adjacent its outer end. The sleeve has two sets of side openings one of the openings in each set being a flow restricting orifice selectively constituting either the first throttling means or the second throttling means and under the user's control connecting either the first or the second check valve to the outer atmosphere. The associated opening of the other set is an orifice large enough to offer negligible resistance to flow of air; under the user's control it connects either the second or the first check valve to the outer atmosphere. There are several flow restricting orifices of different sizes in a circumferential array along the periphery of the sleeve, each being diametrically opposed to a non-flow restricting orifice. Each pair of opposed openings can be successively registered with the opposed check valves when the sleeve is selectively rotated through a few degrees relative to the outer tube. Identifying indicia such as successive numbers or letters are provided on the sleeve adjacent the openings, e.g. one identifying indicia adjacent each opening. Because the flow restricting openings in the sleeve vary in size relative to each other, the pneumatic resistance of the device may be varied by rotating the sleeve to selected positions relative to the outer tube.

The device features an improved pneumatic resistance element, which provides either tension or compression modes. The device avoids the drawbacks accompanying the use of resistance elements such as springs or elastic bands. Also, the present exerciser constitutes relatively few and simple parts, and is easy and inexpensive to manufacture in mass production facilities using unskilled labor.

BRIEF DESCRIPTION OF THE DRAWINGS

In the accompanying drawings in which is shown one of the various possible embodiments of the invention:

FIG. 4 is a sectional transverse view taken substantially along the line 4—4 of FIG. 3;

FIG. 5 is an enlarged sectional view taken substantially along the line 5—5 of FIG. 4; and FIG. 6 is a sectional view taken substantially along the line 6—6 of FIG. 1.

DETAILED DESCRIPTION OF THE PREFERRED EMBODIMENTS

Figure 1:
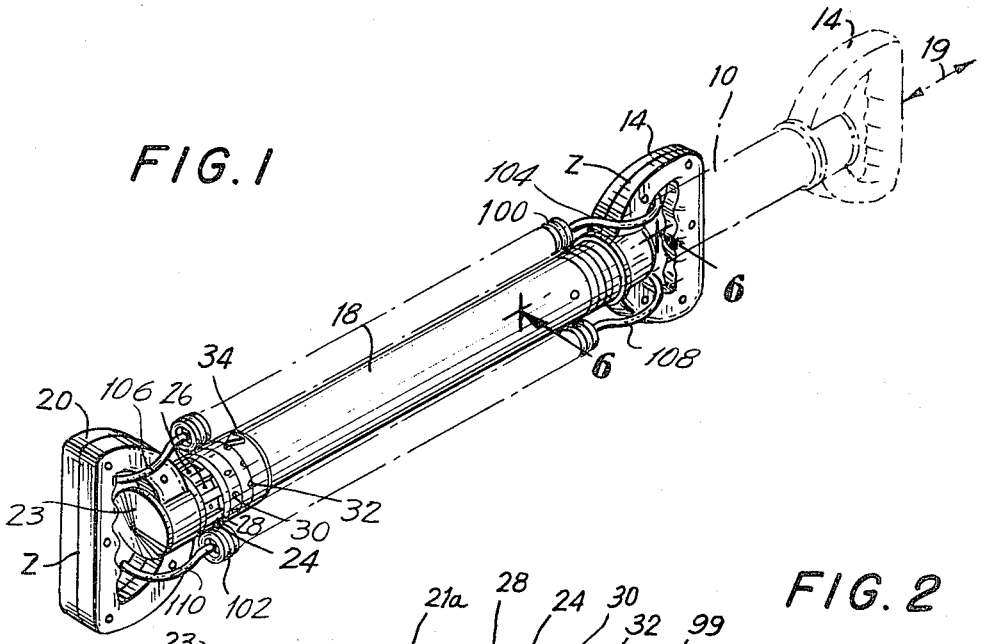
FIG. 1 is a perspective view of the device.

Referring now to FIG. 1, the present exercising device is shown fully contracted in full outline, and partially expanded in phantom outline. It includes a cylindrical inner metal tube 10 having an outer end 12 and an associated bipartite plastic handle 14. The outer end 12 of the inner tube 10 is connected to the handle 14 by a plastic coupling 15 (FIG. 6) having an outer annular handle stop 16 spaced from a cap 17. The mode of alternate expansion and contraction by motion of the elements 10 and 14 towards and away from the balance of the device, is shown by the double-headed arrow 19.

The device also includes a cylindrical outer metal tube 18 in telescoping relationship with the inner tube 10, a bipartite plastic handle 20 at the closed outer end 22 of the outer tube, and a multiply apertured cylindrical sleeve 24 rotatably mounted on a plastic coupling 21 between the handle 20 and the outer tube 18 adjacent the outer end 22. The coupling 21 (FIG. 3) has a handle stop **21*a* and a cap 23**.

The sleeve 24 is characterized by the provision of two sets of circumferentially aligned openings 26, one set being of progressively varying size (see FIG. 4), which are apertures constituting throttling means for both check valves. The other set of openings is of uniform size being large enough to pass air freely without exerting a restricting effect. Each opening of the one set is diametrically opposite a corresponding opening of the other set thereby each opening of one set with the associated opening of the other set forms a pair of openings on diametrically opposite sides of sleeve 24. Thereby when one opening of the set in a given pair is aligned in operative relationship with one of the check valves the other opening from the other set of said pair will be aligned in operative relationship with the other check valve. It will be apparent that any one of the openings of the one set can be aligned with either of the check valves. It also will be apparent that when any one of said restricted openings is aligned with the egress check valve the device will be in its compression mode, offering resistance to telescoping of the device but that when the device is thereafter expanded there will be minimal pneumatic resistance because the flow non-restricting opening of the pair will be aligned with the ingress check valve. It likewise will be apparent that when a flow restricting opening is in alignment with the ingress check valve the device will be in a tension mode during expansion of the device but that when the device thereafter is telescoped the pneumatic resistance offered to such telescoping motion will be slight because a non-flow restricting opening will be aligned with the egress check valve.

Each opening 26 is disposed in a different longitudinal slot 28 on the outer surface of the sleeve 24. Indicia 30, e.g. numbers, are oriented about the outer surface of sleeve 24, each indicia being adjacent its respective slot 28 and opening 26.

A plurality of notches 32 are formed along an edge of the sleeve 24, each notch 32 corresponding to an associated flow restricting opening 26. An indicator 34 readable against the indicia shows which openings 26 are in effective throttling positions at any given time. A detent 36 is urged by a spring 38 (FIG. 3) against the notched edge of the sleeve 24 to selectively detain the sleeve in positions corresponding to the use of a particular desired pair of openings 26 for a specific degree of throttling effect on the pneumatic resistance element.

The openings 26 lead air to or out of the interior of the device, as best seen in FIG. 5 which shows air entering into the expanding exerciser (arrows 40). Air entering via an opening 26 is passed through a felt muffler 42 which prevents sound from emanating from the device as the air flows through the opening 26.

Ingress check valve 44 and egress check valve 46 within the outer tube 18 are located at opposite ends of a hollow two-piece diametrical fitting 48, which is mounted transversely to the central longitudinal axis of the outer tube 18 as shown in FIGS. 4 and 5. The fitting 48 consists of two parts whose inner ends are telescopically interengaged and conjointly define a middle side opening 50 (FIG. 4) for air flow. Outer openings 52, 54 at each end of the fitting 48 enable air to flow to or from the atmosphere. O-rings 56 and 58 at both ends of the fitting 48 pneumatically isolate the ends of the fitting 48, to direct air flow only through the selected openings 26 corresponding to and aligned with the indicator 34. It will be noted that said O-rings touch several surfaces in order to isolate the ends of the fitting 48. Thus as seen in FIGS. 4 and 5 each O-ring touches the exterior side wall at ends thereof, it also touches the outer surface of the outer metal tube 18. It furthermore touches the interior surface of the sleeve 24 around any selected opening 26 and finally although of lesser importance it touches the inner wall of an aperture in the coupling 21.

Referring now to FIG. 5, the check valves 44 and 46 are shown in enlarged detail. Check valve 44 when open as shown allows air entry into the expanding device via opening 26, muffler 42 and opening 52. The check valve 44 includes a spring-loaded ball 60 (spring 62) in a chamber 64 within the fitting 48. The chamber 64 has a seat 66 for the ball 60 at one end, with the seat 66 having the central opening 52 for passage of air. The chamber 64 also has an opening 68 at its other end opposite to the seat 66 for passage of air, so that air can flow inwards from chamber 64 via openings 68 and 50 (arrows 40) and into the interior cavity of the device. As shown in FIG. 5, the two check valves 44 and 46 are aligned in tandem, with the ball seat 66 of the check valve 44 being at an end of the fitting 48, so that its central opening 52 connects to the atmosphere. The other ball seat 70 of the check valve 46 is adjacent the middle of the fitting 48, so that its central opening 72 connects to the middle side opening 50 of the fitting 48. Thus, the check valve 44 permits ingress of air into the outer tube 18, but prevents egress of air from the outer tube 18. The check valve 46 prevents ingress of air into the outer tube; note arrow 74 (FIG. 5) represents a zero air flow since ball 76 is seated in ball seat 70, but check valve 46 permits egress of air from the outer tube 18. Consider as an entity the combined check valves 44 and 46 and their mounting fitting 48 constitutes a thick pin which has an assembly function hereinafter described.

Figure 3:
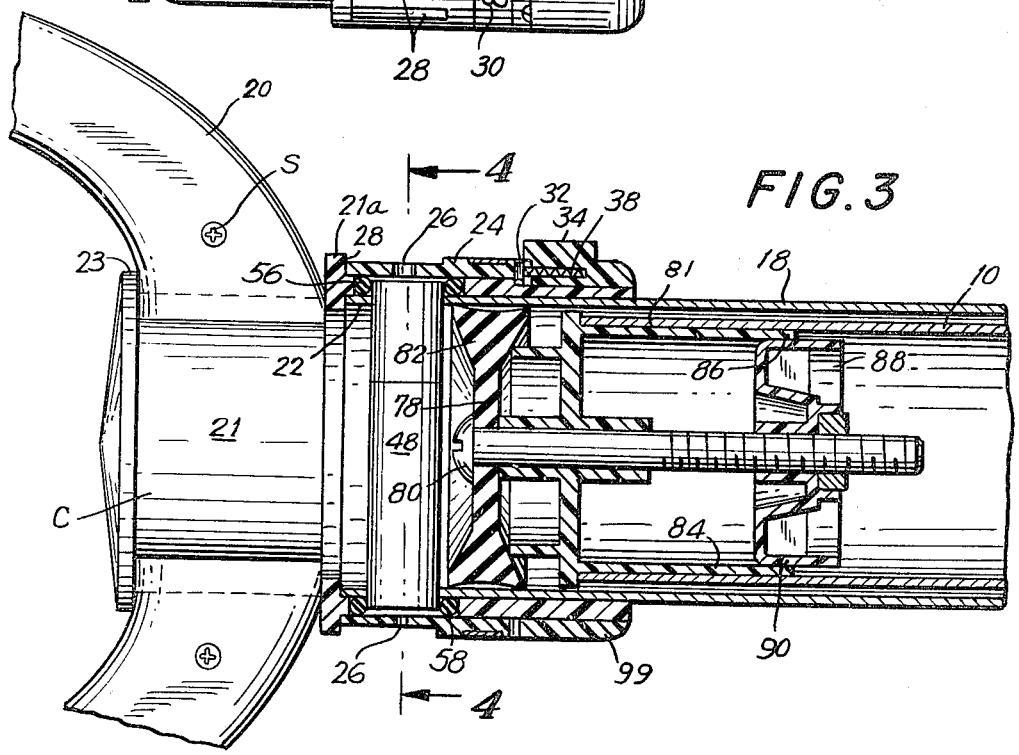
FIG. 3 is a sectional elevation view taken substantially along the line 3—3 of FIG. 2.

Referring now to FIG. 3, a flexible resilient washer 78 is mounted by a screw 80 to the inner end 81 of the inner tube 10, and as shown, the washer 78 is mounted to the inner tube 10 external to the inner end 81 of the inner tube 10 and within the outer tube 18. The washer 78 is typically composed of 60 Shaw durometer rubber, which is a fairly hard rubber, and which may be either a natural rubber or a synthetic rubber such as neoprene or polyvinyl chloride. The washer slidably and sealingly engages the inner surface of the outer tube 18, to generally prevent the leakage of air between the periphery of the washer 78 and the inner surface of the outer tube when the device is manipulated to expand and contract the same. Thus, manipulation of the device alternately draws air into and expels air from within the outer tube 18, and all air flow into or out of the device must work against the pneumatic resistance element which basically and principally consists of the restricted flow orifice openings 26 in the sleeve 24. As shown in FIG. 3, the washer 78 flares outwardly at 82 to a greater thickness adjacent its circular periphery, for improved sealing and greater structural integrity against attrition and wear leading to air leakage after extended service.

The mounting of the washer 78 by the screw 80 to the inner end 81 of the inner tube 10 is accomplished by the provision of a formed fitting 84 having an end 86 with an internal flare into which is fitted a locking plug 88 having a tapered cylindrical outer edge 90 which fits into end 86, so that as the screw 80 is tightened, the member 88 is drawn up into the member 84 until the two tapered surface of 86 and 90 tightly fit into each other. The mating fit between these two tapered surfaces provides a tight seal to the inner end of the inner tube which necessary to prevent leakages of air. It will be observed that by use of these tapered surfaces on the fitting 84 and plug 88 this phase of the assembly of the device, namely the installation of the washer 78 is substantially expedited.

Figure 2:
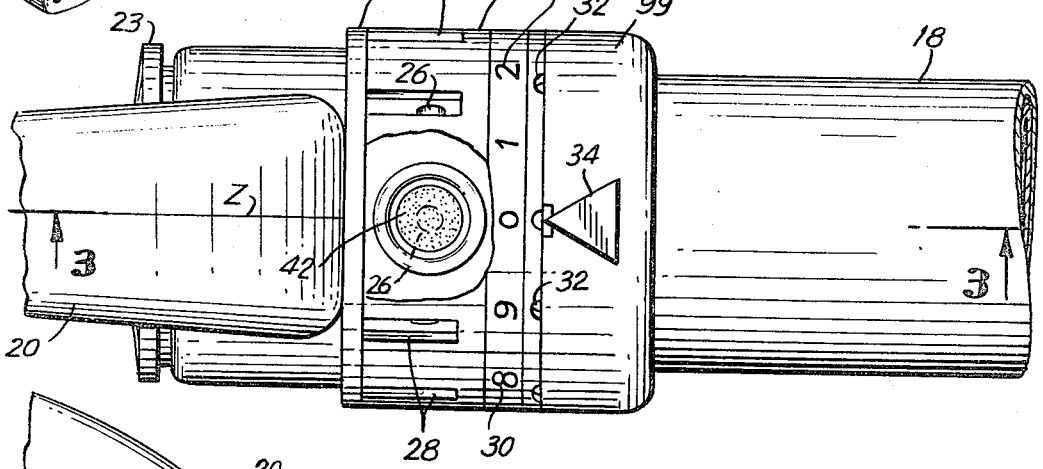
FIG. 2 is a plan view of a portion of the device of FIG. 1, including the rotatable sleeve for variation of the pneumatic resistance.

A novel approach is employed to the mounting of the handles on the outer ends of the outer and inner tubes. The arrangement employed is such that the handles at both ends are identical. It has been observed previously that both handles are bipartite, that is to say, they each constitute two mirror halves which when joined make up a handle. The junction zone between the two halves is indicated by the reference letter Z in FIG. 2. It is along a plane which includes a longitudinal axis of the device; hence one half of each handle is on one side of the device and the other half is on the other lateral side of the device. Each coupling 15, 21 includes a squat central section C of cylindrical configuration and the two halves have mutually facing troughs which match this central section. To mount the two halves of a handle on the coupling the same are simply placed on opposites of the section C, brought into juxtaposition and then held together as with Philip head screws S. The section C of both couplings are identical to permite the mentioned use of identical handles. Such mounting of the handles permit very quick assembly of these components and creats a particularly neat appearance.

It is inadvisable for the outer tube to have a metal to metal slide fit with the inner tube since this would create too much wear, too much friction and too much noise. Accordingly, the inner surface of the outer tube is spaced somewhat e.g. one fourth of an inch on radius, from the outer surface of the inner tube. At the inner end of the inner tube this extra spacing is absorbed by the washer 78. It is also necessary to make provision for this spacing at the inner end of the outer tube. This is accomplished by the use of a split plastic ring 92. The split ring has externally projecting bosses 94, 96. Prior to assembly of the tubes on one another the split ring which has an outer diameter somewhat in excess of the inner diameter of the outer tube is constricted manually enough to permit it to be insertable into the inner end of the outer tube. When this is done the ring is released and it will expand to engage the inner surface of the outer tube. The outer tube is provided with circular holes near its inner end which are located and dimensioned to snuggly receive the bosses 94, 96 when the ring 92 is properly emplaced within the outer tube. The radial thickness of the ring is such that its inner surface will slide nicely on the outer surface of the inner tube. At its outer end the ring is outwardly flanged to cover the inner end surface of the outer tube and also to act as a stop which abuts the coupling 15 of the inner tube when the device is fully telescoped.

To assemble the components of the device, the handle is secured to the outer end of the inner tube in the manner described above, then the inner tube is inserted through the ring 92 which is emplaced on the inner end of the outer tube. At this time the washer 78 has not yet been installed nor has the handle and coupling as yet been mounted on the outer end of the outer tube. Next the washer 78 is installed. This entails securement of the fitting 84, said fitting has an outwardly flanged end (see FIG. 5) which when the device is expanded abuts against the inner end of the ring 92 to limit expandable movement of the device. Next the fitting 21 is slid over the outer end of the outer tube. Said coupling 21 has a pair of diametrically opposed openings aligned with diametrically opposed openings at the outer end of the outer tube. The stub pin constituting the fitting 48 now is slid through these openings which previously are aligned. The pin thus will lock the coupling 21 to the outer end of the outer tube (screws are used to lock the outer end of the inner tube to the coupling 15). The fitting is long enough to extend completely through the outer tube in a transverse direction and to project slightly beyond the outer surface of said tube. The O-rings are snapped about these projecting ends. Next the sleeve 28 is slid onto the outer surface of the coupling 21 and butted against the flange 21*a* (prior to this the sleeve has been on the outer surface of the outer tube away from the coupling 21). Finally a ferrule 99 on which the indicator 34 is mounted is slid onto the coupling 21 to captively hold the sleeve 24 in place longitudinally while still permitting rotation of the sleeve. The ferrule is either a force fit on the coupling 21 or is cemented to the same. The ferrule carries the detent 36.

As will be appreciated from the preceeding description of the operation of the device the sleeve can be turned to set the device up for the operation in either a compression mode or in an expansion mode. In the compression mode the device offers resistance to compression by virtue of the interpositioning of a flow restricting opening in the path of air exiting from the device through the egress check valve. On the return stroke for the compression mode, this being when the device is expanded, a non-flow restricting opening is positioned in the path of travel of air entering the device through the ingress check valve. When the device is in its expansion, i.e. tension, mode the interpositioning of the flow restricting and non-flow restricting openings is reversed. The device can be arranged for yet a third mode of operation which is neither the compression mode nor the expansion mode solely. In the third mode the device provides pneumatic resistance to both expansion and compression. In the third mode the sleeve 24 is so positioned that neither a flow restricting opening nor a non-flow restricting opening is interpositioned in the paths of flow of air into and out of the device. In this third opening the sleeve blocks flow of air into or out of the device through the valves and through said openings. However the device does not have hermetic seals between the tubes; therefore there is some leakage. This leakage permits a restricted inflow and outflow of air into and from the device and provides a suitable pneumatic resistance to expansion and contraction of the device.

FIG. 1 also shows auxiliary tension springs which may be optionally detachably emplaced on the device to increase resistance to expansion. These auxiliary springs are not permanently emplaced on the device but may be removed at the discretion of the user. Each spring 100, 102 is covered with cloth and may be a metallic coil spring or a length of elastic. In any case, spring 100 is attached to the handles 14, 20 by metallic hooks 104, 106 and spring 102 is attached to the handles 14, 20 by metallic hooks 108, 110. It will be appreciated that the hooks 104, 106, 108 and 110 are flexible and somewhat resilient so that they can deform during emplacement or removal of the springs 100, 102. In the preferred form of the device plural pairs of springs 100, 102 are supplied, the different pairs offering different degrees of spring resistance. For example one pair of springs may offer 10 pounds of resistance; another pair 20 pounds and yet a third pair 40 pounds so that increments of resistance from 10 to 70 pounds will be provided.

It thus will be seen that there is provided a device which achieves the various objects of this invention and is well adapted to meet the conditions of practical use.

As various possible embodiments might be made in the embodiment above set forth it is to be understood that all matter herein described or shown in the accompanying drawings is to be interpreted as illustrative and not in a limiting sense.

Having thus described the invention, there is claimed as new and desired to be secured by Letter Patent:

1. An exercising device with a pneumatic resistance element, said device comprising an inner tube, an outer tube in telescoping relationship with the inner tube, handles on the outer ends of the two tubes, the inner end of said inner tube terminating short of the outer end of said outer tube when the tubes are fully telescoped, means closing the outer end of the outer tube, means closing the inner end of the inner tube, said last-named means including flexible resilient means slidably and sealingly engaging the inner surface of the outer tube and substantially preventing the leakage of air between the periphery of said flexible resilient means and the inner surface of the outer tube, first and second check valves within and supported by said outer tube, said check valves carried by the sides of the outer tube end, being disposed between the outer end of the outer tube and said flexible resilient means, said first check valve permitting ingress of air into said outer tube but preventing egress of air from said outer tube, said second check valve preventing ingress of air into said outer tube but permitting egress of air from said outer tube, a sleeve rotatable on said outer tube, said sleeve having a plurality of openings different ones of which are selectively and alternatively coupleable with said check valves to variably control flow of air into or out of said outer tube.

2. An exercising device with a pneumatic resistance element, said device comprising an inner tube, an outer tube in telescoping relationship with the inner tube, handles on the outer ends of the two tubes, the inner end of said inner tube terminating short of the outer end of said outer tube when the tubes are fully telescoped, means closing the outer end of the outer tube, means closing the inner end of the inner tube, said last-named means including flexible resilient means slidably and sealingly engaging the inner surface of the outer tube and substantially preventing the leakage of air between the periphery of said flexible resilient means and the inner surface of the outer tube, first and second check valves within and supported by said outer tube, said check valves being disposed between the outer end of the outer tube and said flexible resilient means, said first check valve permitting ingress of air into said outer tube but preventing egress of air from said outer tube, said second check valve preventing ingress of air into said outer tube but permitting egress of air from said outer tube, a sleeve rotatable on said outer tube, said sleeve having a plurality of openings different ones of which are selectively and alternatively coupleable with said check valves to variably control flow of air into or out of said outer tube, and in which the first and second check valves are mounted at opposite ends of a hollow rectilinear fitting, said fitting being mounted transversely to the central longitudinal axis of the outer tube and having a middle side opening for ingress or egress of air into or out of the outer tube and an outer opening at each end for respective transfer of air to or from the atmosphere.

3. The exercising device of claim 2 in which each check valve comprises a spring-loaded ball in a chamber within the fitting, each chamber having a seat for said ball at one end, each seat having a central opening for passage of air, and each chamber having an opening at the other end opposite to said seat for passage of air, one ball seat being at an end of the fitting so that its central opening connects to the atmosphere, the other ball seat being adjacent the middle of the fitting so that its central opening connects to the middle side opening for the fitting.

4. The exercising device of claim 2 in which a muffler is mounted over each outer end opening of the fitting.

5. The exercising device of claim 2 in which some openings are flow restricting and others are non-flow restricting and in which when a flow restricting opening is coupled to one check valve a non-flow restricting opening is coupled to the other check valve.

6. The exercising device of claim 2 in which each handle is connected to its respective tube by a cylindrical coupling.

7. The exercising device of claim 2 in which the handle for the outer tube is connected to the outer tube by a cylindrical coupling wherein the hollow fitting functions as a pin passing through the fitting and having its ends received in the coupling.

8. The exercising device of claim 7 in which an O-ring engages each end of the fitting to seal the pneumatic connection between each end of the fitting and the inner surface of the sleeve.

9. The exercising device of claim 2 in which the fitting is in two parts, the inner edges of the two parts of the fitting being telescopically interengaged and conjointly defining the side opening.

10. The exercising device of claim 2 in which an inner split ring fitting is secured to the inside of the inner end of the outer tube to slide on the inner tube, said ring fitting having at least one outer protuberance extending through an opening in the outer tube.

11. The exercising device of claim 10 in which the ring fitting has an outwardly extending flange adjacent the inner end of the outer tube.

12. The exercising device of claim 2 in which at least one auxiliary linear spring extends between the opposed handles of the tubes, each end of said spring being detachably secured to a different one of the handles.

13. The exercising device of claim 12 in which a plurality of springs is provided, the number of springs being an even number, and half of the plurality of springs being mounted to one side of the device, the other half of the springs being mounted to the other side of the device.

14. An exercising device with a pneumatic resistance element, said device comprising an inner tube, an outer tube in telescoping relationship with the inner tube, handles on the outer ends of the two tubes, the inner end of said inner tube terminating short of the outer end of said outer tube when the tubes are fully telescoped, means closing the outer end of the outer tubes, means closing the inner end of the inner tube, said last-named means including flexible resilient means slidably and sealingly engaging the inner surface of the outer tube and substantially preventing the leakage of air between the periphery of said flexible resilient means and the inner surface of the outer tube, first and second check valve within and supported by said outer tube, said check valves being disposed between the outer end of the outer tube and said flexible resilient means, said first check valve permitting ingress of air into said outer tube but preventing egress of air from said outer tube, said second check valve preventing ingress of air into said outer tube but permitting egress of air from said outer tube, a sleeve rotatable on said outer tube, said sleeve having a plurality of openings different ones of which are selectively and alternatively coupleable with said check valves to variably control flow of air into or out of said outer tube and in which some openings are flow restricting and other are non-flow restricting and in which when a flow restricting opening is coupled to one check valve a non-flow restricting opening is coupled to the other check valve.

* * * * *

UNITED STATES PATENT AND TRADEMARK OFFICE

CERTIFICATE OF CORRECTION

PATENT NO. : 4,290,599

DATED : September 22, 1981

INVENTOR(S) : Isaac Berger and Albert Stubbmann

It is certified that error appears in the above—identified patent and that said Letters Patent is hereby corrected as shown below:

On The Title Page:

Change Inventor: Isaac Berger to: Inventors: Isaac Berger and Albert Stubbmann

Signed and Sealed this

Eighth Day of December 1981

[SEAL]

Attest:

GERALD J. MOSSINGHOFF

Attesting Officer

Commissioner of Patents and Trademarks